United States Patent [19]

Lovatto et al.

[11] Patent Number: 4,615,062

[45] Date of Patent: Oct. 7, 1986

[54] PROCESS OF FORMING A KNITTED CURING MATERIAL

[76] Inventors: Pietro Lovatto; Maria de los Angeles Tello, both of Ignacio Arteaga No. 31, Circuito Navegantes, Ciudad Satélite, 53100, Naucalpan de Juárez, Estado de México, Mexico

[21] Appl. No.: 744,922

[22] Filed: Jun. 14, 1985

[51] Int. Cl.[4] ..... D06B 3/02

[52] U.S. Cl. ..... 8/149.3; 428/253

[58] Field of Search ..... 8/147, 149.3; 428/36, 428/253

[56] References Cited

U.S. PATENT DOCUMENTS 4,393,532 7/1983 Sando et al. ..... 8/149.3

4,571,765 2/1986 Okado et al. ..... 8/149.3

*Primary Examiner*—James J. Bell

*Attorney, Agent, or Firm*—McGlew and Tuttle

[57] ABSTRACT

A process for obtaining a hydrofiltering mesh knitting material for curing comprises combining oleofinic, polyamide and polyester textile fibers in order to obtain a mesh knitting comprises subjecting the knitting to a thermic finishing by placing a formation of the knitting within an autoclave and injecting the autoclave by aspersion with a water steam having a pH from 5 to 6 and at a pressure of 1.5 kilograms per square centimeter at a temperature of 130° C. for 30 minutes. The knitting which is obtained in this process comprises 30% oleofinic fibers, 34% of polyamide fibers and 36% of polyester fibers. The form knitting is advantageously given a further thermic finishing so that it is tightened by 2.1%.

3 Claims, No Drawings

PROCESS OF FORMING A KNITTED CURING MATERIAL

BACKGROUND OF THE INVENTION

FIELD OF THE INVENTION

This invention relates, in general, to the formation of a product useful for covering body wounds and, in particular, to a new and useful process for forming a hydrofiltering mesh material.

Accordingly, it is an object of the invention to provide an improved hydrofiltering mesh knitting suitable for use in curing the skin which comprises combining oleofinic polyamide and polyester textile fibers to obtain a mesh knitting and subjecting the mesh knitting to a thermic finishing by placing it within an autoclave and injecting by aspersion, water steam with a pH of 5–6 and at a pressure of 1.5 kilograms per square centimeter and at a temperature of 130° C. for 30 minutes.

GENERAL DESCRIPTION OF THE PREFERRED EMBODIMENTS

It has been seen that within the suitable synthetic textile fibers, the combination of olefinic, polyamide and polyester fibers produces a mesh knitting which is suitable for hydrofiltering and for curing purposes, which by means of a thermic finishing is a material of optimum results. Even when the combination of said fibers can be made for the objects herein before indicated in different percentages, it has been found, however, that the more adequate percentages are the following:

olefinic fibers—30%
Polyamide fibers—34%
Polyester fibers—36%

The procedure for the obtention of the finishing physical-thermic treatment is performed as follows: once the appropiated mesh knitting is obtained, the knitting logs are placed within an autoclave being injected by aspersion, water steam with a pH 5–6, at a pressure of 1.5 kilograms per square centimeter, at a temperature of 130° C., during 30 minutes.

The finishing treatment disclosed above, causes the synthetic fibers composing the knitting, due to their thermoplastic characteristics to be tightened in a 2.1% on average, without degrading, being perfectly uniform in its peripherical structure, to the point that with this physical process, it becomes repelling to the fluids and humidity, and when in touch with the epidermis, it leaves this place always dry.

Namely, this treatment tries to obtain the total elimination of fluids retained by capillarity on the filtering knitting.

When the knitting is put in touch with the epidermis and over injuries, ulcers, burns and so on, it drains all kind of fluids and suppurations, without adhering to the epidermis, helping in this way to a quick cicatrization. Besides, it is very useful to isolate the epidermis from humidity, at the moment of plastering in ortrhopedy and thraumathology.

Notwithstanding the above disclosure was made regarding one specific embodiment of this invention, it should be understood by all those skilled in this art, that any change in form or detail will be comprised within the spirit and scope of this invention.

What is claimed is:

1. A method for obtaining a hydrofiltering mesh suitable for use for covering a portion of the body, comprising forming thread of oleofinic, polyamide and polyester textile fibers, making the thread in a mesh knitting, and subjecting the knitting to a thermic finishing by placing the knitting within an autoclave and injecting the autoclave by aspersion with a water steam having a pH from 5 to 6, and at a pressure of 1.5 kilograms per square centimeter and at a temperature of 130° C. for 30 minutes.

2. A method according to claim 1, wherein said thread comprises 30% olefinic fibers, 34% polyamide fibers and 36% polyester fibers.

3. A method according to claim 2, including affecting a thermic finishing to tighten the knitting by 2.1%.

* * * * *